US007874873B2

(12) United States Patent
Do et al.

(10) Patent No.: US 7,874,873 B2
(45) **Date of Patent: *Jan. 25, 2011**

(54) CONNECTOR WITH REFERENCE CONDUCTOR CONTACT

(75) Inventors: Trent K. Do, Nashua, NH (US); Thomas S. Cohen, New Boston, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/363,881

(22) Filed: Feb. 2, 2009

(65) Prior Publication Data

US 2009/0197483 A1 Aug. 6, 2009

Related U.S. Application Data

(62) Division of application No. 11/220,382, filed on Sep. 6, 2005, now Pat. No. 7,494,379.

(51) Int. Cl.
*H01R 13/648* (2006.01)

(52) U.S. Cl. ..... 439/607.35; 439/108

(58) Field of Classification Search ..... 439/108, 439/607.07, 607.08, 607.09, 607.11, 607.12, 439/607.27, 607.35

See application file for complete search history.

(56) References Cited

U.S. PATENT DOCUMENTS

| | | | | |
|---|---|---|---|---|
| 6,299,483 | B1 | 10/2001 | Cohen et al. | |
| 6,554,647 | B1 | 4/2003 | Cohen et al. | |
| 6,602,095 | B2 | 8/2003 | Astbury, Jr. et al. | |
| 6,607,402 | B2 | 8/2003 | Cohen et al. | |
| 6,739,918 | B2 | 5/2004 | Cohen et al. | |
| 6,764,349 | B2 | 7/2004 | Provencher et al. | |
| 6,776,659 | B1 | 8/2004 | Stokoe et al. | |
| 6,827,611 | B1 | 12/2004 | Payne et al. | |
| 6,872,085 | B1 | 3/2005 | Cohen et al. | |
| 7,074,086 | B2 * | 7/2006 | Cohen et al. | 439/607.08 |
| 7,094,102 | B2 | 8/2006 | Cohen et al. | |
| 7,108,556 | B2 | 9/2006 | Cohen et al. | |
| 7,494,379 | B2 * | 2/2009 | Do et al. | 439/607.05 |

* cited by examiner

*Primary Examiner*—Thanh-Tam T Le
(74) *Attorney, Agent, or Firm*—Blank Rome LLP

(57) ABSTRACT

An electrical connector with a reference contact for improved shielding. The contact provides multiple points of contact between members in the ground structure of two mating connectors. The points of contact are arranged to provide desirable current flow in the signal paths and ground structures of the connectors. The contact is stamped from a shield plate and has multiple elongated members that provide spring force for adequate electrical connection. The elongated members are curved to position the points of contact with the desired orientation. Such a contact structure may be used alone or in combination with other compliant structures providing further points of contact.

9 Claims, 9 Drawing Sheets

CONNECTOR WITH REFERENCE CONDUCTOR CONTACT

CROSS-REFERENCE TO RELATED APPLICATION

The present application is a division of U.S. application Ser. No. 11/220,382, filed Sep. 6, 2005, now U.S. Pat. No. 7,494,379 to Do et al. issued Feb. 24, 2009, the entire disclosure of which is incorporated herein by reference.

BACKGROUND OF INVENTION

1. Field of Invention

This invention relates generally to electrical interconnection systems and more specifically to electrical interconnection systems, such as high speed electrical connectors, with improved signal integrity.

2. Discussion of Related Art

Electrical connectors are used in many electronic systems. Electrical connectors are often used to make connections between printed circuit boards ("PCBs") that allow separate PCBs to be easily assembled or removed from an electronic system. Assembling an electronic system on several PCBs that are then connected to one another by electrical connectors is generally easier and more cost effective than manufacturing the entire system on a single PCB.

Electronic systems have generally become smaller, faster and functionally more complex. These changes mean that the number of circuits in a given area of an electronic system, along with the frequencies at which those circuits operate, have increased significantly in recent years. Current systems pass more data between PCBs than systems of even a few years ago, requiring higher density electrical connectors that operate at higher frequencies.

As connector density signal frequencies increase, there is a greater possibility of electrical noise being generated in the connector as a result of reflections caused by impedance mismatch or cross-talk between signal conductors. Therefore, electrical connectors are designed to control cross-talk between different signal paths and to control the impedance of each signal path. Shield members, which are typically metal strips or metal plates connected to ground, can influence both cross-talk and impedance when placed adjacent the signal conductors. Shield members with an appropriate design can significantly improve the performance of a connector.

Different shielding arrangements are more or less effective, depending on the overall construction of the connector. For example, electrical connectors can be designed for single-ended signals or differential signals. A single-ended signal is carried on a single signal conducting path, with the voltage relative to a common reference conductor being the signal. Differential signals are signals represented by a pair of conducting paths, called a "differential pair." The voltage difference between the conductive paths represents the signal. In general, the two conducing paths of a differential pair are arranged to run near each other. No shielding is desired between the conducting paths of the pair, but shielding may reduce cross-talk when used between differential pairs.

Despite recent improvements in high frequency performance of electrical connectors provided by shielded electrical connectors, it would be desirable to have an to interconnection system with even further improved performance.

SUMMARY OF INVENTION

In one aspect, the invention relates to a contact adapted for use in an electrical assembly. The connector comprises a planar conductive member having a surface and a compliant structure. The compliant structure comprises a first member and a second member having a first end and a second end. The first end of the first member is attached to the planar conductive member and the second end extends above the surface. The first end of the second member is attached to the planar conductive member and the second end of the second member extends above the surface. A third member of the compliant structure is coupled between the second end of the first member and the second end of the second member.

In another aspect, the invention relates to an electrical connector comprising a plurality of columns of signal conductors, each column comprising a plurality of pairs of signal conductors. The electrical connector also includes a plurality of conducting structures, each positioned adjacent a respective column of the plurality of columns of signal conductors, a plurality of first type compliant structure connected to each of the plurality of conducting structures, each of the first type compliant structures positioned adjacent a pair of the plurality of pairs of signal conductors in the respective column and providing at least two distinct contact regions; and a plurality of second type compliant structure connected to each of the plurality of conducting structures, each of the second type structures positioned above a compliant structure of the plurality of first type compliant structures and providing at least one distinct contact region.

In a further aspect, the invention also relates to a method of operating an electrical connector of the type having a first piece with a plurality of signal conducting structures having mating portions disposed in columns and a plurality of ground members, each of the plurality of ground members disposed adjacent a respective column of signal conducting structures, and a second piece with a plurality of signal conducting structures having mating portions disposed in columns and a plurality of ground members, each ground member disposed adjacent a respective column of signal conducting structures and at least a portion of the plurality of ground members in the second piece having a plurality of contact areas with each contact area having a plurality of contact regions adapted to engage a respective ground member in the first piece. The method comprises positioning the first piece and the second piece with each of the mating portions of the plurality of signal conducting structures in the first piece aligned with the mating portion of a signal conducting structure of the plurality of signal conducting structures in the second piece and with each of the plurality of ground members in the second piece aligned with the respective ground member of the first piece. The first piece and the second piece are moved together to sequence mating of the first piece and the second piece, by: engaging a first contact region in each of the plurality of contact areas with the respective ground structure. A second contact region in each of the plurality of contact areas is engaged with the respective ground structure. A third contact region in each of the plurality of contact areas is engaged with the respective ground structure. At the end of the mating sequence, each of the ground members in the second piece is electrically coupled to the respective ground member of the first piece at least three points adjacent each of the mating portions of the plurality of signal conducting structures in the first piece and in the second piece.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
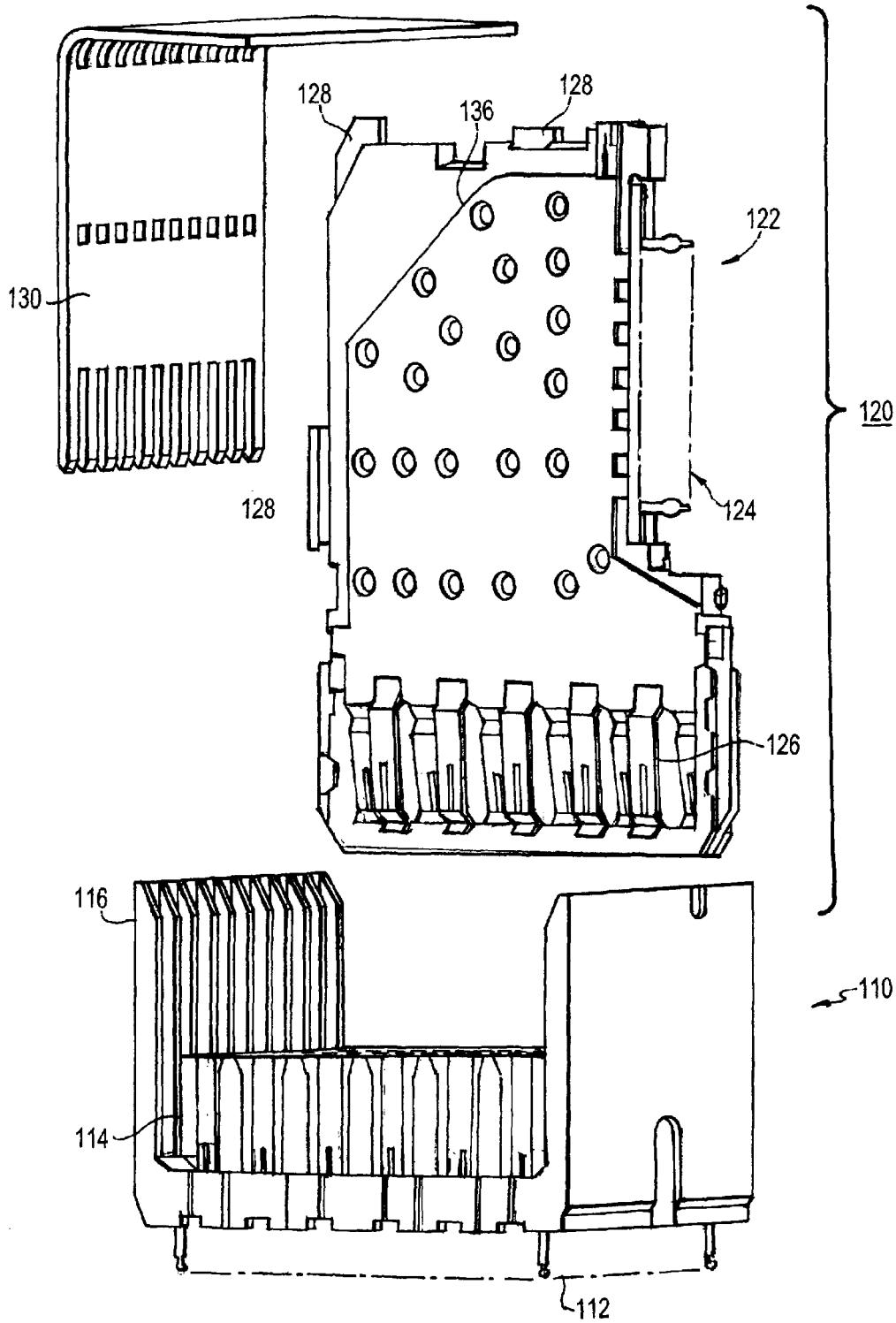
FIG. 1 (PRIOR ART)
FIG. 1 is a sketch of a prior art connector.

An improved interconnection system is provided with a reference conductor having a contact providing two or more points of contact when mated. Such a contact provides a low impedance interconnection and may be constructed to provide other advantages, such as a desirable ground current flow pattern and reduced ringing in connectors having advance ground mating.

The invention is illustrated in connection with a backplane-daughter card interconnection system. However, the invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

FIG. 1 shows an exemplary prior art connector system that may be improved with a shielding system according to the invention. In the example of FIG. 1, the electrical connector is a two-piece electrical connector adapted for connecting a printed circuit board to a backplane at a right angle. The connector includes a backplane connector 110 and a daughter card connector 120 adapted to mate to the backplane connector 110.

Backplane connector 110 includes multiple signal conductors arranged in columns. The signal conductors are held in housing 116, which is typically molded of plastic or other insulative material.

Each of the signal conductors includes a contact tail 112 and a mating portion 114. In use, the contact tails 112 are attached to conducting traces within a backplane (not shown). In the illustrated embodiment, contact tails 112 are press-fit contact tails that are inserted into via holes in the backplane. The press-fit contact tails make an electrical connection with a plating inside the via that is in turn coupled to a trace within the backplane. Other forms of contact tails are known and the invention is not limited to any specific form. For example, electrical connectors may be constructed with surface mount or pressure mounted contact tails.

In the example of FIG. 1, the mating portions 114 of the signal conductors are shaped as blades. The mating portions 114 of the signal conductors in the backplane connector 110 are positioned to mate with mating portions of signal conductors in daughter card connector 120. In this example, mating portions 114 of backplane connector 110 mate with mating portions 126 of daughter card connector 120, creating a separable mating interface through which signals may be transmitted.

The signal conductors within daughter card connector 120 are held within housing 136, which may be formed of a plastic or other similar insulating material. Contact tails 124 extend from housing 136 and are positioned for attachment to a daughter card (not shown). In the example of FIG. 1, contact tails 124 for daughter card connector 120 are press-fit contact tails similar to contact tails 112. However, any suitable attachment mechanism may be used.

In the embodiment illustrated, daughter card connector 120 is formed from multiple wafers 122. For simplicity, a single wafer 122 is shown in FIG. 1. Wafers such as wafer 122 are formed as subassemblies that each contain signal conductors for one column of the connector. The wafers are held together in a support structure, such as metal stiffener 130. Each wafer includes attachment features 128 on its housing that may attach the wafer 122 to stiffener 130.

Stiffener 130 is one example of a support structure that may be used to form a connector, but the invention is not limited for use in connection with connectors having stiffeners. Support structures may be provided in the form of insulated housings, combs, and metal members of other shapes. Further, in some embodiments, a support member may be omitted entirely. Wafers may be held together by mechanical means, adhesive or other means. Alternatively, the connector may be formed of a unitary housing into which signal conductors are inserted.

When assembled into a connecter, the contact tails 124 of the wafers extend generally from a face of an insulating housing of daughter card connector 120. In use, this face is pressed against a surface of a daughter card (not shown), making connection between the contact tails 124 and signal traces within the daughter card. Similarly, the contact tails 112 of backplane connector 110 extend from a face of housing 116. This face is pressed against the surface of a backplane (not shown), allowing the contact tails 112 to make connection to traces within the backplane. In this way, signals may pass from a daughter card, through the signal conductors in daughter card connector 120 and into the signal conductors of backplane connector 110 where they may be connected to traces within a backplane.

When desired, shields may be placed between the columns of signal conductors in the backplane and the daughter card. These shields may likewise include contact portions that allow current to pass across the mating interface between daughter card connector 120 and backplane connector 110. Such shield members are typically connected to ground on the daughter card and the backplane, providing a ground plane through the connector that reduces crosstalk between signal conductors and may also serve to control the impedance of the signal conductors.

Figure 2A:
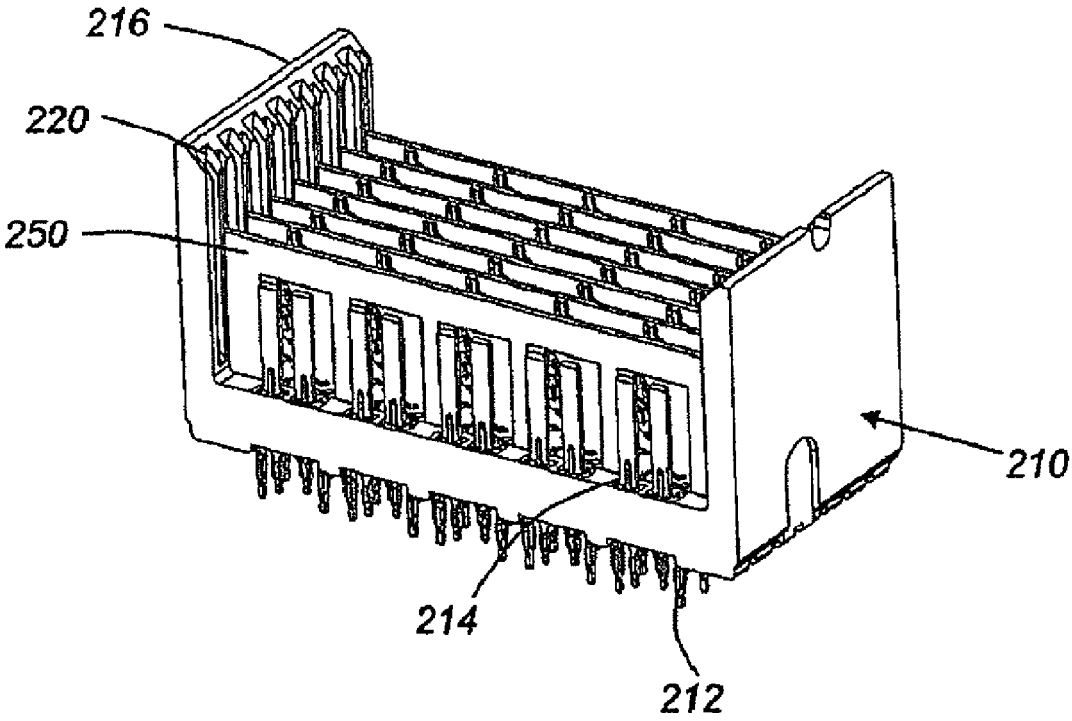
FIG. 2A is a sketch of a backplane connector according to one embodiment of the invention.

FIG. 2A shows a backplane connector 210 according to an embodiment of the invention. Backplane connector 210 includes a housing 216, which may be molded of plastic or other suitable material. Each signal conductor is embedded in housing 216, with a mating portion 214 extending above the housing and a contact tail 212 extending from a face on the lower surface of the housing.

As in the prior art, both the contact tails 212 and mating portions 214 of the signal conductors may be positioned in multiple parallel columns in housing 216. In the pictured embodiment, the signal conductors are positioned in pairs within each column. Such a configuration is desirable for connectors carrying differential signals. FIG. 2A shows five pairs of signal conductors in each column. In this embodiment, the pairs of signal conductors are positioned such that the signal conductors within a pair are closer together than the spacing between a signal conductor in one pair and the nearest signal conductor in an adjacent pair. In some embodiments, grounded members may be placed in the space between pairs of signal conductors for improved shielding.

In the illustrated embodiment, a shield 250 is positioned between each column of signal conductors. Each shield here is shown to be held in a slot 220 within housing 216. However, any suitable means of securing shields 250 may be used.

Each of the shields 250 is made from a conductive material. In the pictured embodiment, each shield is made from a sheet of metal. However, conducting structures may be formed in any suitable way, such as doping or coating non-conductive structures to make them fully or partially conductive. In some embodiments, shields 250 include compliant members. If compliant members are stamped from the same sheet of conductive material used to form shield 250, that sheet may be a metal such as phosphor bronze, beryllium copper or other ductile metal alloy.

Each shield 250 may be designed to be coupled to ground when backplane connector 210 is attached to a backplane. Such a connection may be made through contact tails on shield 250 similar to contact tails 212 used to connect signal conductors to the backplane. However, shield 250 may be connected directly to ground on a backplane through any suitable type of contact tail or indirectly to ground through one or more intermediate structures.

Figure 2B:
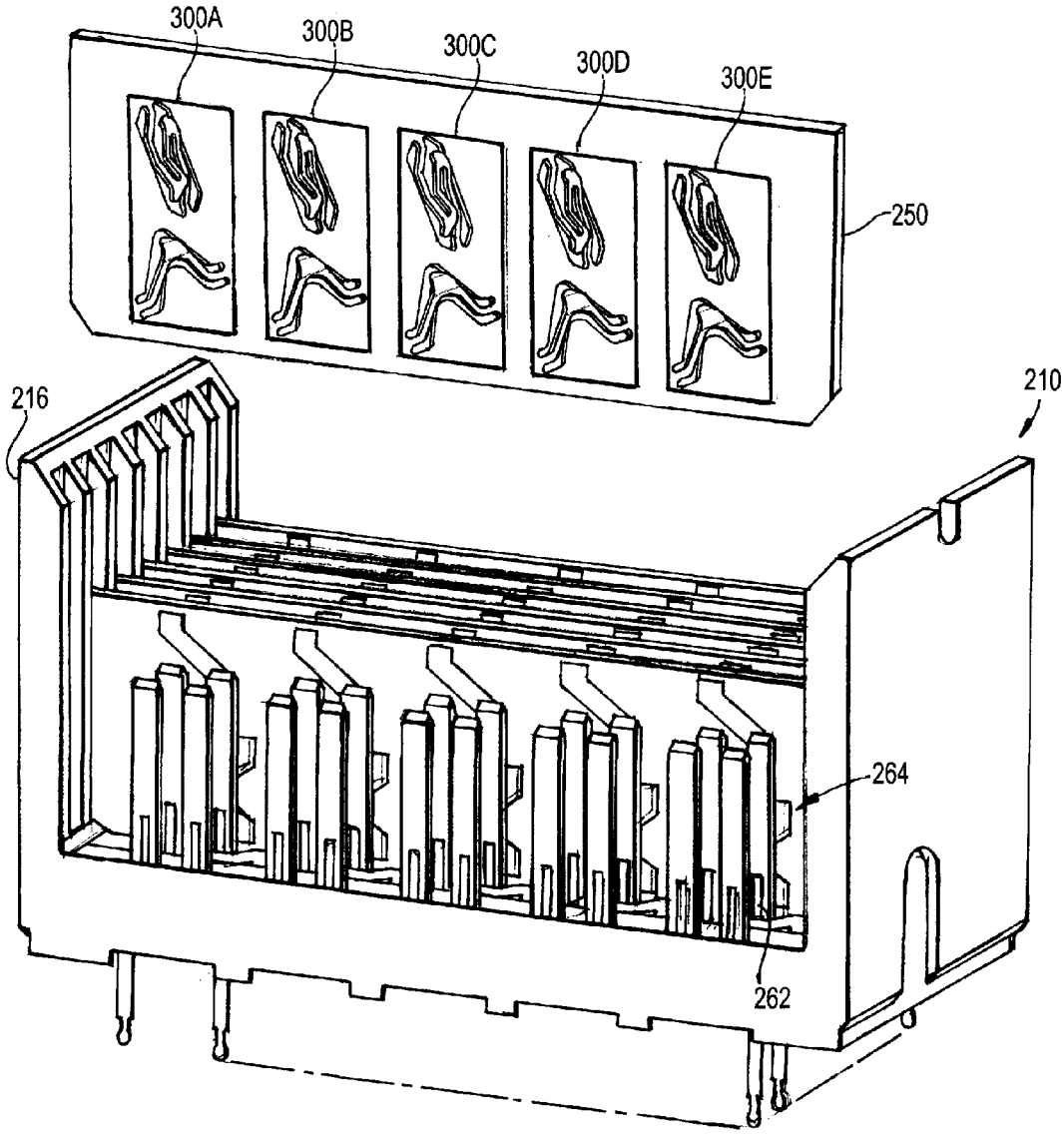
FIG. 2B is a sketch, partially exploded, of the backplane connector of FIG. 2A.

FIG. 2B shows a partially exploded view of backplane connector 210. In FIG. 2B, a shield 250 is shown removed from housing 216. This view reveals adjacent columns 262 and 264 of signal conductors that are separated by shield 250 when shield 250 is installed in housing 216.

As pictured in FIG. 2B, shield 250 includes multiple contact portions 300A, 300B, 300C, 300D, and 300E. When shield 250 is inserted within housing 216, one contact portion is positioned adjacent each of the pairs of signal conductors in the adjacent columns, such as 262 and 264.

Each contact region may be formed by stamping and forming structures from the metal sheet making up shield 250. Contact portions 300A, 300B, 300C, 300D, and 300E may be formed as part of the same operation used to stamp and form shield 250. If desired, each contact portion may be plated in whole or in part with a material that improves the electrical characteristics of the contact. For example, gold, tin, nickel, or other suitable material may be plated over all or part of each contact portion to reduce oxide formation or to reduce contact resistance.

Figure 3A:
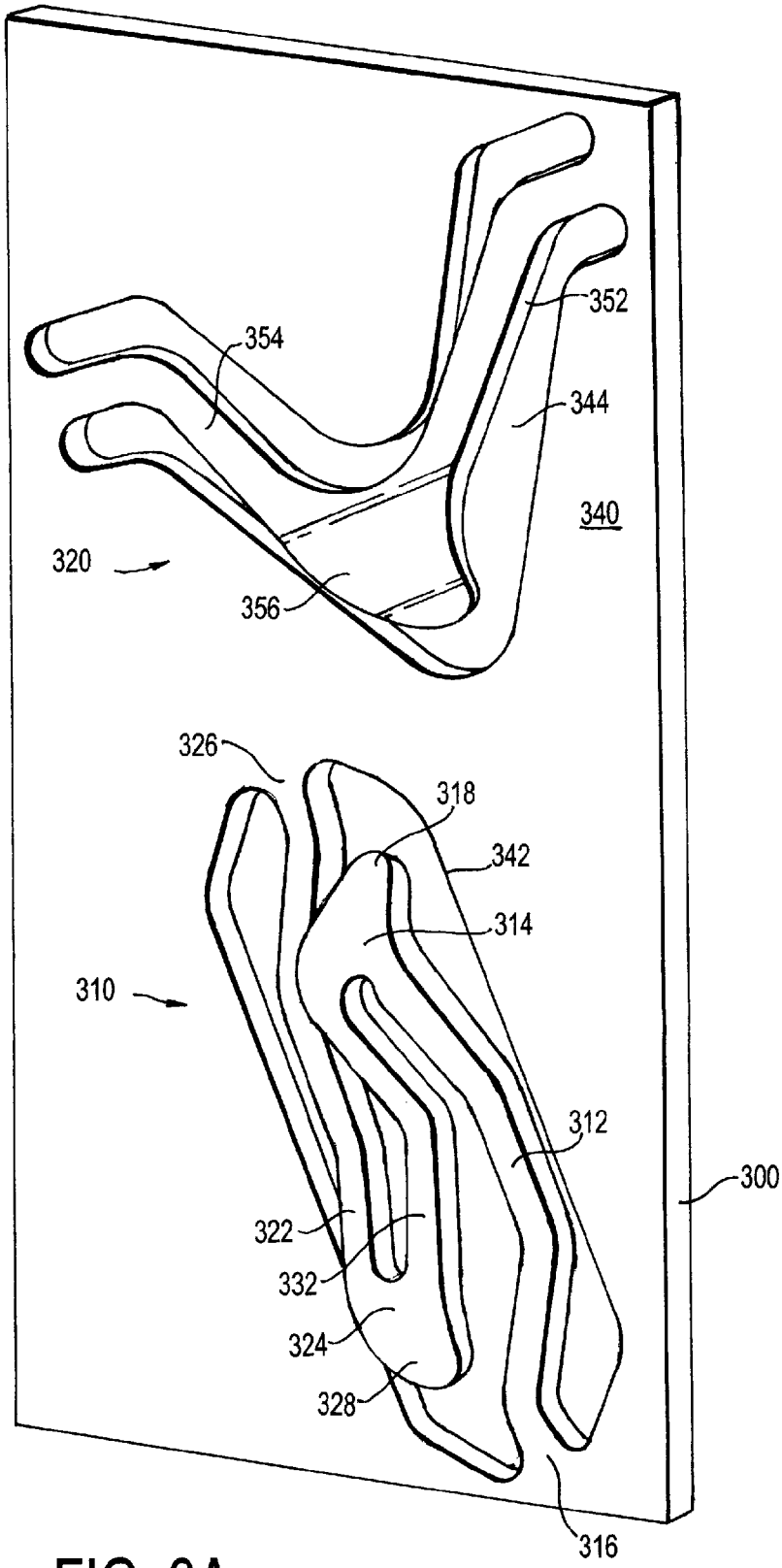
FIG. 3A is a sketch of a contact portion of the backplane connector of FIGS. 2A and 2B.

FIG. 3A shows a representative contact portion 300 in greater detail. In the embodiment of FIG. 3A, contact portion 300 includes compliant structure 310 and compliant structure 320. In this embodiment, compliant structure 310 and compliant structure 320 both include elongated members stamped from shield 250 and formed to bend out of the plane of surface 340. The stamping operation leaves openings 342 and 344 in surface 340 in which members of each compliant structure may move. In embodiments in which contact portion 300 is used as part of a high density connector, contact portion 300 may have a width of about 10 mm or less and a height of about 15 mm or less. In one embodiment, contact portion 300 has a width of about 5 mm, and a height of about 7 mm.

Compliant structure 310 is shown here to include elongated member 312. Elongated member 312 has a contact region 314 formed at one end and an attachment region 316 at an opposing end by which elongated member 312 is attached to shield 250. The elongated member 312 has a width, length and thickness to provide adequate travel and spring force to form a good electrical connection. In some embodiments, elongated member 312 has a thickness between about 0.1 and 0.5 mm, a width between about 2 and 5 mm, and a length between about 3 and 8 mm.

Elongated member 312 is curved with a compound curve in the illustrated embodiment. One component of the compound curve elevates contact region 314 above surface 340. A second component of the compound curve positions contact region 314 and attachment region 316 for a desirable current flow pattern through shield 250 while ensuring elongated member 312 has a length that provides suitable mechanical properties and fits in the space available in a high density connector. When backplane connector 210 is mated with a corresponding daughter card connector, contact region 314 makes electrical connection with a shield member in the daughter card connector, thereby forming a conducting path between shield 250 and a shield member in the daughter card. The electrical connection is the result of contact region 314 pressing against the shield member in the daughter card connector as a result of the spring force generated by compliant structure 310.

Compliant structure 310 also includes elongated member 322. Elongated member 322 includes contact region 324 at one end and an attachment region 326 at an opposing end. Contact region 324, similar to contact region 314, makes electrical connection to a shield member in the daughter card connector. Elongated member 322 is also formed with a compound curve that provides the same functionality as the curves in elongated member 312.

For improved mechanical robustness, compliant structure 310 includes elongated member 332 that joins elongated members 312 and 322. Elongated member 332 also aids in the performance of the interconnection system by facilitating current sharing between elongated members 312 and 322. By allowing current to be shared between elongated members 312 and 322, the current flow in the ground system may better match the current flow in the signal path) which can reduce noise in the signal path. To reduce the chance that elongated member 322 will stub upon insertion of a daughter card connector into backplane connector 210, contact region 324 is formed with a flap 328 that tapers toward surface 340. Elongated member 332 also reduces the chances of members of the compliant structure stubbing upon mating by activating contact region 314 in advance of engaging a mating contact.

Contact region 314 also includes a flap 318 that tapers toward surface 340. Flap 318 reduces contact wear that may occur upon un-mating of the backplane and daughter card connector.

Further points of contact between shield 250 in a backplane connection and a ground structure in a matting conductor are provided by compliant structure 320. Compliant structure 320 includes elongated member 352 and elongated member 354. Elongated members 352 and 354 may be stamped from a sheet of material used to form shield 250. Elongated members 352 and 354 are each attached at one end to shield 250.

At the other ends, elongated members 352 and 354 bend out of surface 340 and join to form contact region 356. As with contact region 324, contact region 356 may also include a tapered flap to reduce the chance of stubbing upon mating with a daughter card connector.

In some embodiments, compliant structure 320 is about 0.1 to 0.5 mm thick, about 2 to 10 mm wide and has a height of about 7 to 12 mm.

Figure 3B:
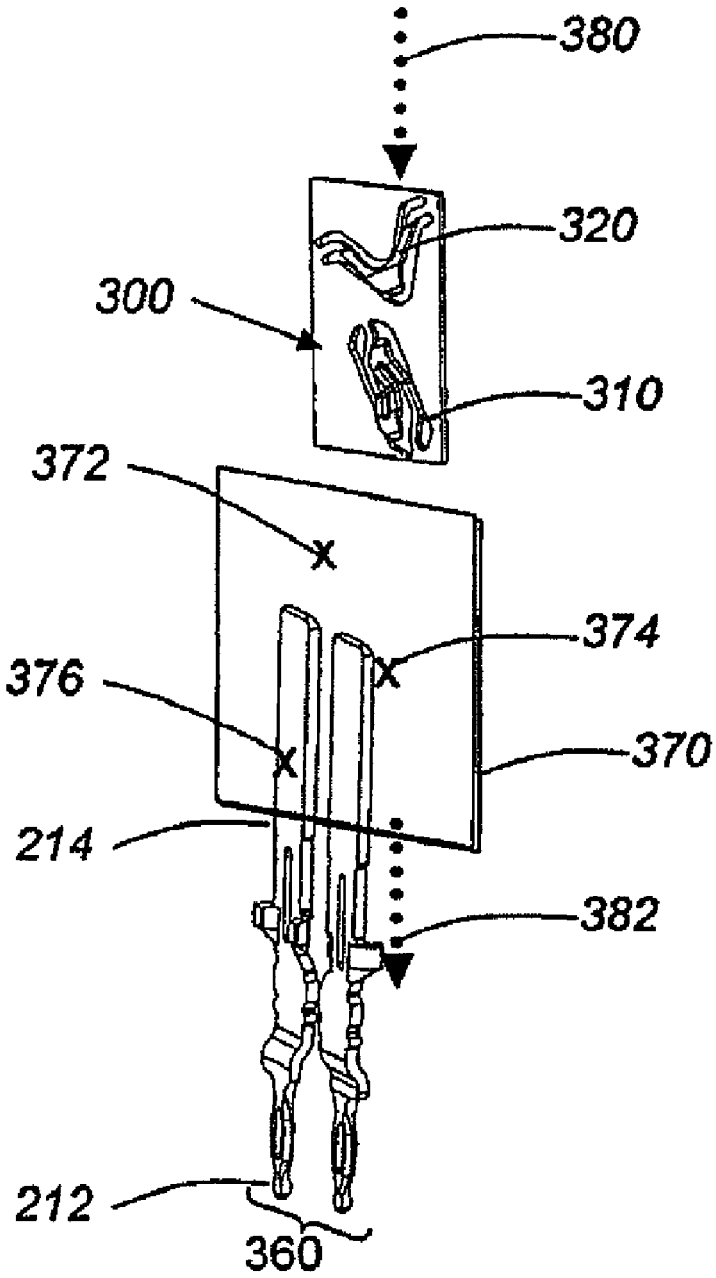
FIG. 3B is a sketch useful in understanding the current flow path through a shielding system.

FIG. 3B illustrates contact region 300 in operation. Contact region 300 may be a portion of a shield or ground structure in either connector of a two-piece connector assembly. When the connectors of such a two-piece connector assembly are mated, contact region 300 makes electrical contact with a shield, a blade, or other portion of a ground conductor in the mating connector of the two-piece electrical connector. In the embodiment of FIG. 3, the mating portion is illustrated as ground conductor 370. The specific structure of ground conductor 370 is not critical to the invention and is illustrated as a blade for simplicity.

As illustrated, ground conductor 370 is adjacent mating portions 214 of signal conductors such as may be used in backplane connector 210. In this embodiment, the shield structure carrying contact region 300 may be a portion of a shield on a daughter card connector and ground conductor 370 may be a portion of a shield in a backplane connector.

As the backplane and daughter card connectors are mated, contact region 300 will slide relative to ground conductor 370. Initially, compliant structure 310 will engage ground conductor 370. In the embodiment illustrated, ground conductor 370 extends above the signal conductors 390A and 390B. Such a configuration allows what is sometimes called "advance mating" of the ground conductors. It ensures that appropriate power and ground connections are made to a daughter card before any signal conductors are connected. Such a mating sequence ensures that electronic components on the daughter card are in a defined state before signals are applied to these components and thereby avoids damage to the component or incorrect operating states.

As part of the mating sequence, the tapered surface of flap 328 will first engage the leading edge of ground conductor 370. The tapered surface will convert downward force on contact region 300 into a force that presses the portions of compliant structure 310 extending above surface 340 toward surface 340.

The spring force generated by the elongated members of the compliant structure 310 as they are pressed toward surface 340 will force contact regions 314 and 324 against ground conductor 370, thereby forming electrical connection between contact region 300 and ground conductor 370.

As the daughter card and backplane are pressed together during mating, compliant structure 310 will slide along ground conductor 370, maintaining contact. Compliant structure 320 will eventually engage ground conductor 370. The spring force generated by the elongated members of compliant structure 320 will likewise press contact region 356 against ground conductor 370.

The multiple contact regions of contact portion 300 will create multiple points of contact between the ground structure of the daughter card and the ground structure of the backplane. In the embodiment illustrated in FIGS. 3A and 3B, contact portion 300 includes three contact regions that create points of contact 372, 374 and 376 on ground conductor 370. Points of contact 372, 374 and 376 are here shown to be aligned generally along a line adjacent to and parallel with mating portions 214 of a pair 360 of signal conductors. When contact portion 300 is a portion of a ground system in an electronic system, current may flow from ground into contact portion 300 along current path 380. Similarly, ground conductor 370 may be connected to ground such that current may flow from ground conductor 370 to ground along current path 382. The arrangement of contact points 374 and 376 generally along a line adjacent to and parallel with the signal conductors allows a ground current path that is also generally parallel with and adjacent to the current flow in the signal path. Such symmetric signal and ground current flow paths reduce the inductance of the signal path and also reduces coupling of signals from one set of signal conductors to nearby sets of signal conductors. Accordingly, providing a reference conductor contact structure that allows such a symmetric current flow path improves the electrical performance of an overall connector system.

Further, we have found that including points of contact along the length of ground conductor 370 also improves the electrical performance of the connector. Incorporating multiple compliant structures in contact portion 300 allows the points of contact to be spread over a longer length. For example, point of contact 372 provided by compliant structure 320 reduces ringing in ground conductor 370 that otherwise occurs in portions of ground member 370 extending above contact points 374 and 376. Reducing ringing in another way that the electrical performance of a connector incorporating contact portion 300 may be improved.

In the illustrated embodiment, the specific shapes for compliant structure 310 and compliant structure 320 are chosen to provide sufficient mechanical force at the contact points 372, 374 and 376, while still allowing the contact points to be disposed substantially along a line that follows the line of current flow in signal conductors 390A and 390B. Other shapes of compliant structures may be used. Where greater space is available, additional points of contact may be used. For example, a compliant structure in the form of compliant structure 310 may be used in place of compliant structure 320, thereby providing four points of contact along a line generally parallel with and adjacent to each pair of signal conductors. However, if a high density connector with a relatively small spacing between pairs of signal conductors is desired, the space available for compliant structures may constrain the types of compliant structures that may be used. In some embodiments, spacing between adjacent signal conductors may be 2 mm or less with pairs of signal conductors spaced by 6 mm or less. If signal conductors are formed with such small spacings, compliant structures according to embodiments of the invention can provide sufficient contact force to provide reliable electrical connections in the available space.

Figure 4:
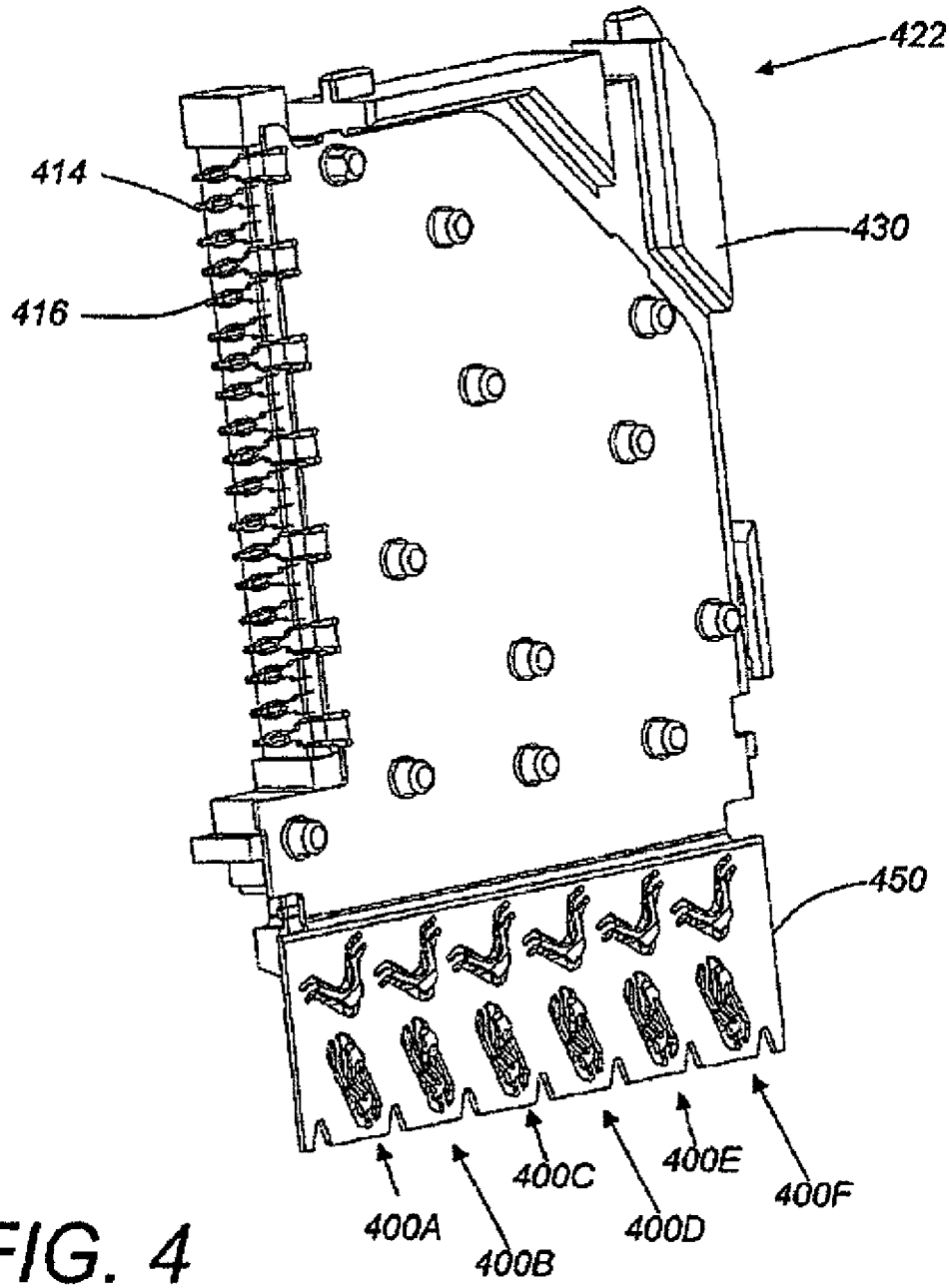
FIG. 4 is a sketch of a daughter card wafer according to an alternative embodiment of the invention.

The contact portion as illustrated in FIG. 3A may be incorporated into a ground structure in any connector that forms a portion of a separable interface. For example, the contact portion is shown in a backplane connector in FIG. 2B and in a daughter card connector in FIG. 4. FIG. 4 illustrates a wafer 422 with a shield 450 having contact portions 400A, 400B, 400C, 400D, 400E and 400F. Six such contact portions may be used in a differential connector carrying six differential pairs of signal conductors per wafer. Such contact portions include compliant structures 310 and 320 as illustrated in FIG. 3A, which may mate with ground structures in a mating backplane connector.

In the illustrated embodiment, shield 450 includes contact tails 416 that may make electrical connection to ground conductors within a daughter board. Shield 450 includes multiple contact tails, with each shield contact tail 416 positioned between contact tails 414 of a pair of signal conductors.

Figure 5:
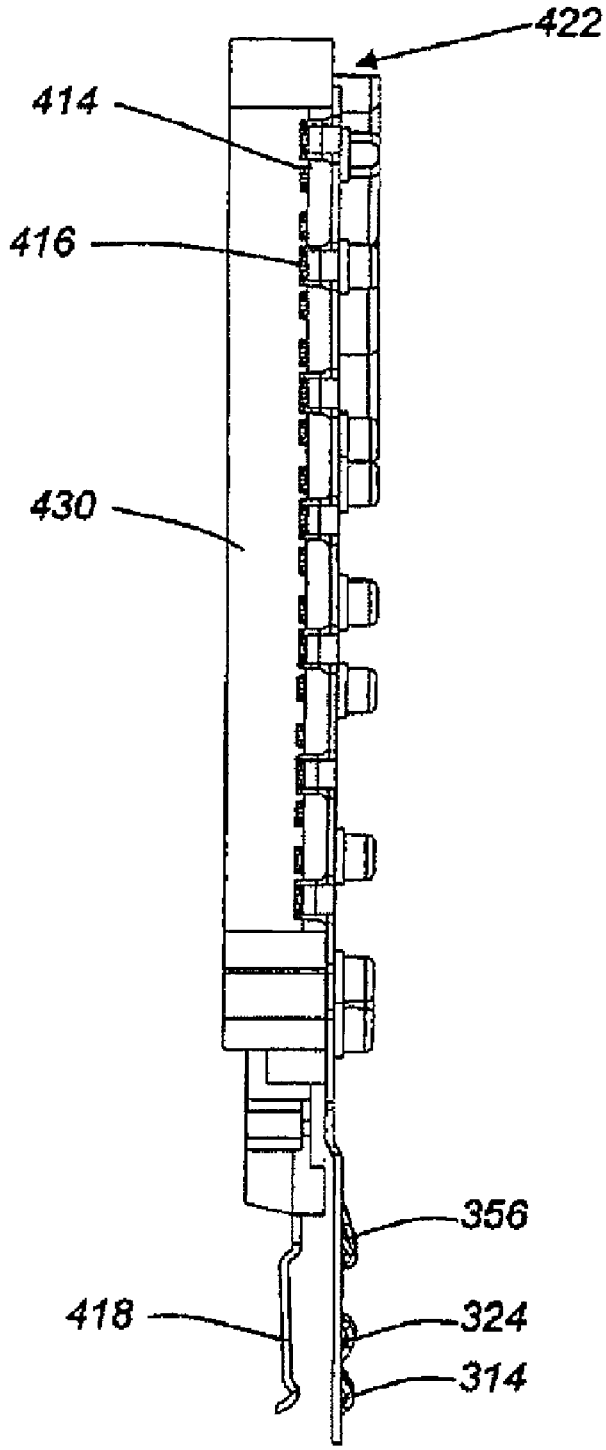
FIG. 5 is a side view of the daughter card wafer of FIG. 4.

FIG. 5 shows a side view of wafer 422. As can be seen in FIG. 5, each signal conductor of wafer 422 extends from housing 430 as a mating contact portions 418. In the illustrated embodiment, wafer 422 forms a differential signal wafer and pairs of signal conductors are aligned with each of the contact portions 400A, 400B, 400C, 400D, 400E, and 400F. As can be seen in the side view of FIG. 5, contact regions 314, 324, and 356 extend above the surface of shield 450 to make electrical contact with a shield in a mating connector. As discussed above in connection with FIG. 3B, multiple points of contact provides an improved shielding system.

Figure 6:
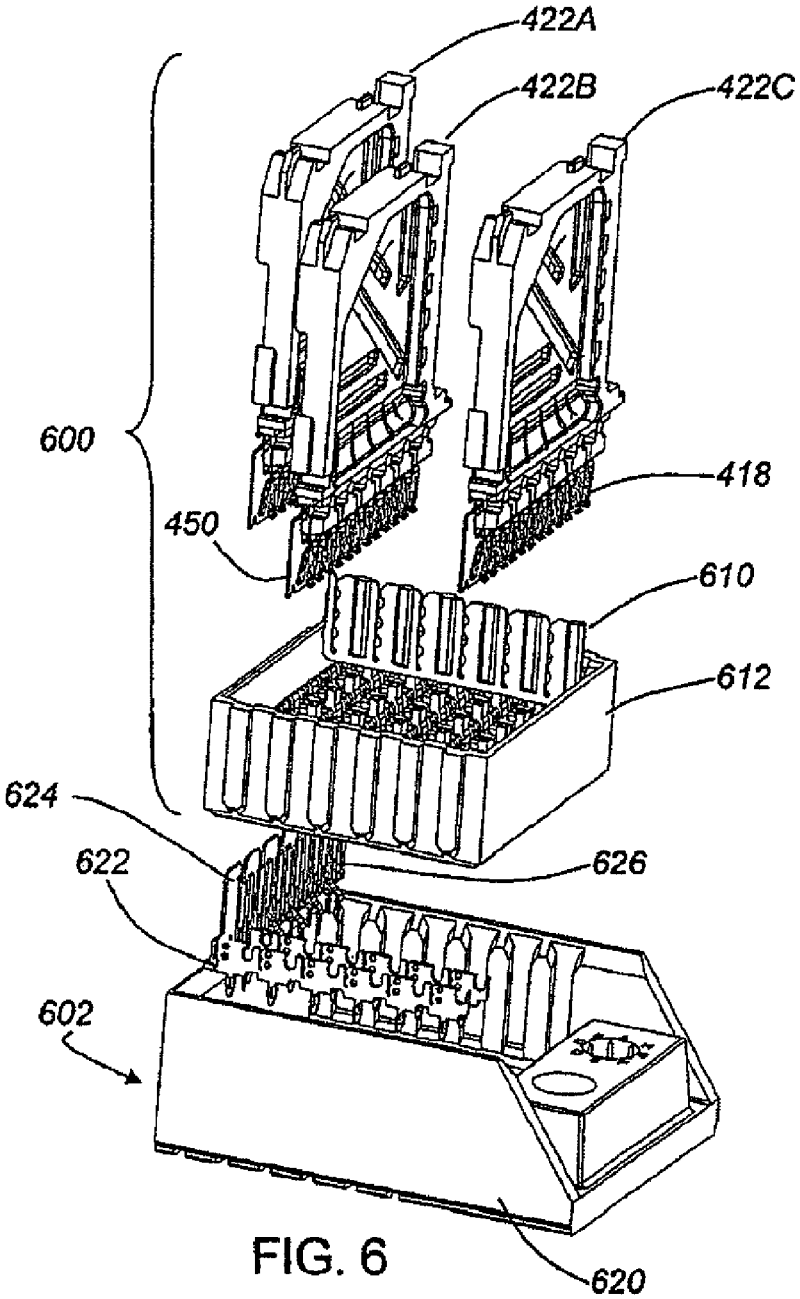
FIG. 6 is a partially exploded view of a connector system according to an embodiment of the invention.

FIG. 6 provides an example of a connector assembly using wafers such as are shown in FIGS. 4 and 5. The connector assembly includes multiple such wafers of which wafers 422A, 422B, and 422C are shown. Wafers 422A, 422B, and 422C are held in a housing 612. Housing 612 may be molded of an insulative material such as is traditionally used to form housings for electrical connectors. Wafers are inserted into housing 612 such that the signal conductors within each wafer form one column of signal conductors in daughter card connector 600. A shield 450 associated with each wafer is adjacent the column of signal conductors formed by that wafer.

For additional shielding, shield members 610 are inserted into housing 612. Shield members 610 run perpendicular to shields 450. In embodiments in which daughter card connector 600 is a differential signal connector, shields 610 are positioned between each pair of mating portions 418.

Backplane connector 602 includes a housing 620 that includes columns of signal conductors 626. Each of the signal conductors 626 is shaped as a blade, providing a mating surface to which a mating portion 418 may make contact. The signal conductors are disposed in pairs with shield members 622 running perpendicular to the columns between each pair. Each shield member 622 includes contact tails 710 (FIG. 7) connecting the ground structures within backplane connector 602 to ground.

Figure 7:
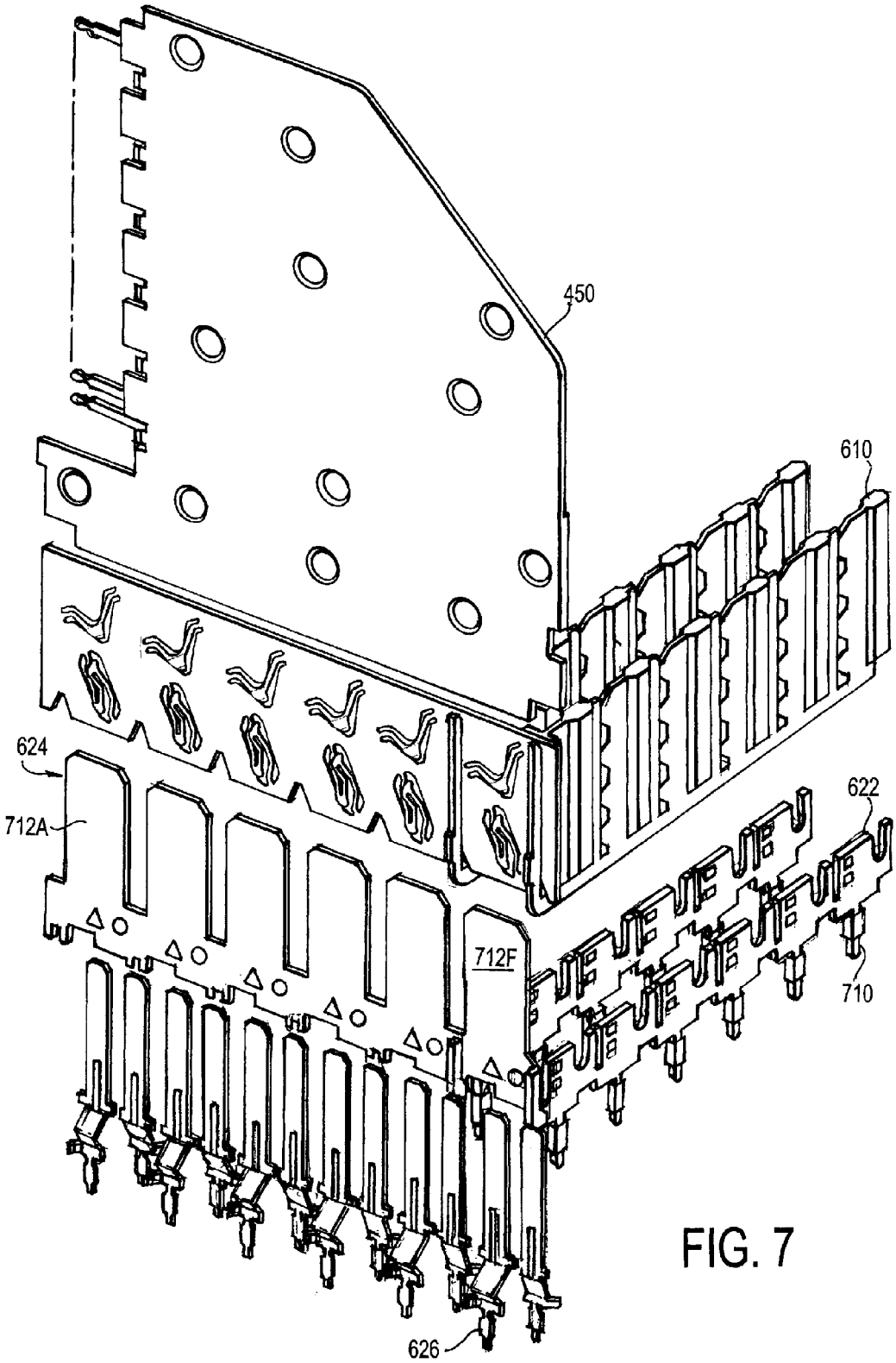
FIG. 7 is a partially exploded and cut-away view of the shielding system of the connector system of FIG. 6.

Shield members 624 run parallel to and adjacent each of the columns of signal conductors 626. As shown in FIG. 7, each of the shield members 624 includes multiple shield blades 712A . . . 712F (of which only 712A and 712F are numbered for simplicity). Each of the shield blades is positioned to make contact with one of the contact portions 400A . . . 400F adjacent one pair of signal conductors.

The resulting ground structure formed by shields 450 and 610 in the daughter card connector and shield members 624 and 622 in backplane connector 602 forms a shielding enclosure substantially on all sides of each pair of signal conductors at the mating interface of the connector. Incorporating a contact portion such as contact portion 300C providing multiple points of contact between the ground structure in the daughter card and ground structure in the backplane connector in a way that facilitates current flow through the ground structure symmetric with current flow through the signal conductors thereby increasing the high frequency performance of the overall connector system. Such connectors may operate at frequencies in excess of 10 GHz.

Having thus described several aspects of at least one embodiment of this invention, it is to be appreciated various alterations, modifications, and improvements will readily occur to those skilled in the art.

For example, the invention is illustrated in connection with a backplane/daughter card connector system. Its use is not so limited. It may be incorporated into connectors such as are typically described as mid-plane connectors, stacking connectors or mezzanine connectors or in any other interconnection system.

Further, compliant structure 310 is illustrated as having two points of contacts. A compliant structure may be formed having more than two points of contact.

As an example of a further variation, it was described that housings for each of the connectors are formed with insulative material. Housings may be formed in any suitable way. For example, mixtures of insulative and conductive materials may be used, including a metal substrate with insulative inserts. Alternatively, mixtures of lossy conductive and lossy dielectric materials may be used in connection with insulative portions. Lossy conductive materials may be used to reduce resonances within the connection system or otherwise improve the efficiency of the grounding structure.

As a further example, signal conductors are described to be arranged in rows and columns. Unless otherwise clearly indicated, the terms "row" or "column" do not denote a specific orientation. Also, certain conductors are defined as "signal conductors." While such conductors are suitable for carrying high speed electrical signals, not all signal conductors need be employed in that fashion. For example, some signal conductors may be connected to ground or may simply be unused when the connector is installed in an electronic system.

Likewise, some conductors are described as ground or reference conductors. Such connectors are suitable for making connections to ground, but need not be used in that fashion.

Also, the term "ground" is used herein to signify a reference potential. For example, a ground could be a positive or negative supply and need not be limited to earth ground.

As another example, current flow in FIG. 3B is illustrated by arrows. The arrows illustrate motion of charged particles, rather than a required direction for current flow.

Also, it was described that each contact portion included two compliant structures. The compliant structures may be used either alone or in combination. Further, such compliant structures may be used with other compliant structures to provide the desired number of points of contact.

Such alterations, modifications, and improvements are intended to be part of this disclosure, and are intended to be within the spirit and scope of the invention. Accordingly, the foregoing description and drawings are by way of example only.

What is claimed is:

1. A contact adapted for use in an electrical assembly, comprising:

a) a planar conductive member having a surface; and b) a compliant structure comprising:

i) a first member having a first end and a second end, the first end of the first member attached to the planar conductive member and the second end extending above the surface;

ii) a second member having a first end and a second end; the first end of the second member attached to the planar conductive member and the second end of the second member extending above the surface; and iii) a third member, coupled between the second end of the first member and the second end of the second member, wherein the first member is elongated along a first axis and the second member is elongated along a second axis and the first axis is substantially parallel to the second axis, and wherein the third member is elongated along a third axis and the third axis is substantially parallel to the first and second axes.

2. The contact of claim 1, wherein the planar conductive member comprises a metal sheet.

3. The contact of claim 2, wherein first member, the second member and the third member are stamped from the metal sheet.

4. The contact of claim 1, wherein the planar conductive member has an opening formed therein and the first, second and third members are positioned in the opening.

5. The contact of claim 1, wherein the planar conductive member comprises a plurality of compliant structures shaped like the compliant structure, with the compliant structure and each of the plurality of compliant structures centered substantially along a line.

6. The contact of claim 5, additionally comprising a plurality of second compliant structures coupled to the planar conductive member, each of the plurality of second compliant structures being positioned adjacent to a corresponding one of the plurality of compliant structures, with each second compliant structure offset from the corresponding one of the plurality of compliant structures in a direction substantially perpendicular to the line.

7. The contact of claim 1, wherein the first member and the second member are curved.

8. The contact of claim 1, wherein the planar conductive member comprises a plurality of compliant structures shaped like the compliant structure, with the compliant structure and each of the plurality of compliant structures centered substantially along a line and the first axis is transverse to the line.

9. The contact of claim 1, wherein the first member and the second member each has a width between about 2 and 5 mm, and a length between about 3 and 8 mm.

* * * * *